US007101237B1

(12) United States Patent
Dai

(10) Patent No.: US 7,101,237 B1
(45) Date of Patent: Sep. 5, 2006

(54) PROPELLOR BLADE ADJUSTMENT SYSTEM FOR PROPULSION THROUGH FLUID ENVIRONMENTS UNDER CHANGING CONDITIONS

(75) Inventor: Charles M. Dai, Potomac, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 79 days.

(21) Appl. No.: 10/863,843

(22) Filed: Jun. 3, 2004

(51) Int. Cl.
*B63H 3/00* (2006.01)

(52) U.S. Cl. ..... 440/50; 416/23

(58) Field of Classification Search ..... 440/50, 440/53; 114/330, 338; 416/23, 24, 43, 46, 416/49, 61, 132 A, 140, 143, 147, 48; 244/212, 244/215

See application file for complete search history.

(56) References Cited

U.S. PATENT DOCUMENTS 3,228,477 A * 1/1966 Breslin ..... 416/24
4,648,345 A * 3/1987 Wham et al. ..... 114/338
4,929,153 A * 5/1990 Speer ..... 416/46
5,415,523 A * 5/1995 Muller ..... 416/48
5,639,215 A * 6/1997 Yamakawa et al. ..... 416/23
6,322,324 B1 * 11/2001 Kennedy et al. ..... 416/23
6,340,290 B1 * 1/2002 Schott et al. ..... 416/157 R
6,669,444 B1 * 12/2003 Alacqua et al. ..... 416/132 A
6,776,580 B1 * 8/2004 Fink et al. ..... 416/23

* cited by examiner

*Primary Examiner*—Lars A. Olson
(74) *Attorney, Agent, or Firm*—Jacob Shuster

(57) ABSTRACT

The stern end of a seawater hull has a rotor hub with propeller blades thereon. The rotor hub is rotated for propulsion of the hull by means of a propeller shaft extending through a sealed compartment within the hull. Such sealed compartment and an electrically powered control system is disposed within the hull to automatically adjust angular deflection of deformable tip portions of the propeller blades by means of blade embedded actuators, in response to varying input signals which respectively reflect changes in seawater conditions such as temperature and strain imposed on the propeller blades during propelling rotation of the rotor hub.

7 Claims, 2 Drawing Sheets

PROPELLOR BLADE ADJUSTMENT SYSTEM FOR PROPULSION THROUGH FLUID ENVIRONMENTS UNDER CHANGING CONDITIONS

STATEMENT OF GOVERNMENT INTEREST

The invention described herein may be manufactured and used by or for the Government of the United States of America for governmental purposes without the payment of any royalties thereon or therefore.

The present invention relates generally to hydrodynamic or aeronautical propulsion by rotation of a bladed propeller.

BACKGROUND OF THE INVENTION

Because of adverse changes in environmental conditions that too often occur, it has become rather difficult to arrange for the maintenance of appropriate and effective hydrodynamic or aeronautic propulsion and for maneuvering of submarines or aircraft under speed and/or directional control. Marine propeller blades are varied in cross-sectional profile for example to reduce vortices induced vibrations during propulsion. The control systems for such active hydrodynamic surface controls, heretofore designed for optimal performance under varying environmental conditions, involved application of electromagnetic/mechanical control of control surfaces having shape memory alloy material cores. Such control systems for propulsive surfaces, such as propeller blades, were functionally limited because of complexities associated with inherent tensioning. It is therefore an important object of the present invention to provide for enhanced active control by adjustment of hydrodynamic or aeronautical shaped surfaces, such as rotor blades having shape memory material associated therewith.

SUMMARY OF THE INVENTION

Pursuant to the present invention, propeller blades on a hub connected to a propulsion shaft have tips within which torque transfer plates are embedded. Electrical control current is supplied to the blades through the propulsion shaft for deformation adjustment of the blade tips under control of a computer sealed within a stern portion of a hull from which the propulsion shaft extends. Input signals are fed to the computer reflecting changes in environmental fluid temperature, blade rotational propelling force in the propulsion shaft and strain imposed on the blade tips during adjustment.

BRIEF DESCRIPTION OF THE DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF THE PREFERRED EMBODIMENT

Figure 1:
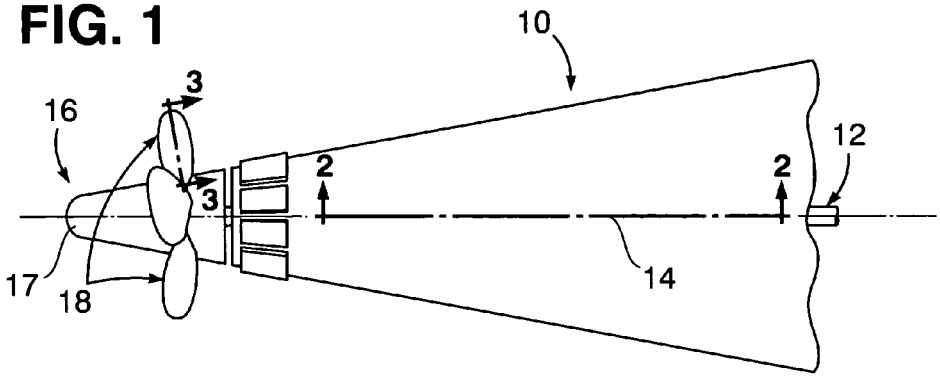
FIG. 1 is a side elevation view of the stern portion of a hull on which a propulsion unit is mounted pursuant to one embodiment of the present invention.

Referring now to the drawing in detail, FIG. 1 illustrates a marine hull 10 having a stern end portion through which a propeller shaft 12 extends for rotation about a rotational axis 14 extending from a propulsion unit 16 associated with an aft end hub section 17 of the hull end portion. A plurality of propeller blades 18 project from the hub section 17.

Figure 2:
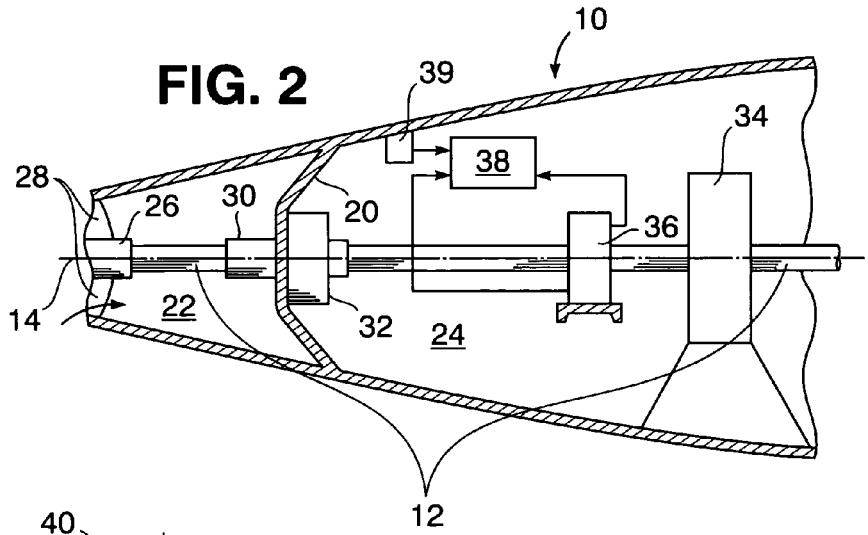
FIG. 2 is a partial section view of the hull shown in FIG. 1 taken substantially through a plane indicated by section line 2—2, with control facilities illustrated therein.

As shown in FIG. 2, the stern portion of the hull 10 is internally divided by a transverse bulkhead 20 into a stern tube enclosure 22 and a watertight compartment 24 within which fluid is sealed. The stern tube enclosure 22 is exposed inside thereof to ambient seawater by inflow at its aft end. The propeller shaft 12 extends forwardly into the stern tube 22 through a bearing 26, fixed in position therein by support hull struts 28, in spaced relation to an axially aligned bearing 30 fixed to the bulkhead 20. Also fixed to the bulkhead 20 on its inboard side within the sealed compartment 24 is a shaft seal 32 through which the propeller shaft 12 extends to maintain pressure integrity between the stern tube enclosure 22 and the compartment 24, so as to prevent ingress of the seawater from the enclosure 22 into the compartment 24 and egress of the fluid therefrom. An axial thrust bearing 34 for the propeller shaft 12 is fixed in position by the hull 10 in axially spaced alignment with the shaft seal 32 so as to accommodate transfer of forward and reverse propulsion forces developed during rotation of the propulsion unit 16. Also fixedly positioned over the propeller shaft 12 within the compartment 24 between the shaft seal 32 and the thrust bearing 34 is a slip ring assembly 36 through which electrical current is conducted by wiring extending through the propeller shaft 12 between an electrical power controller 38 as diagrammed in FIG. 2 and the propulsion unit 16 as shown in FIG. 1 for controlled adjustment of the propeller blades 18 on the hub section 17 as hereinafter explained. A temperature gauge 39 as also diagrammed in FIG. 2 is also provided within the compartment 24 for measurement of seawater temperature externally of the hull 10.

Figure 3:
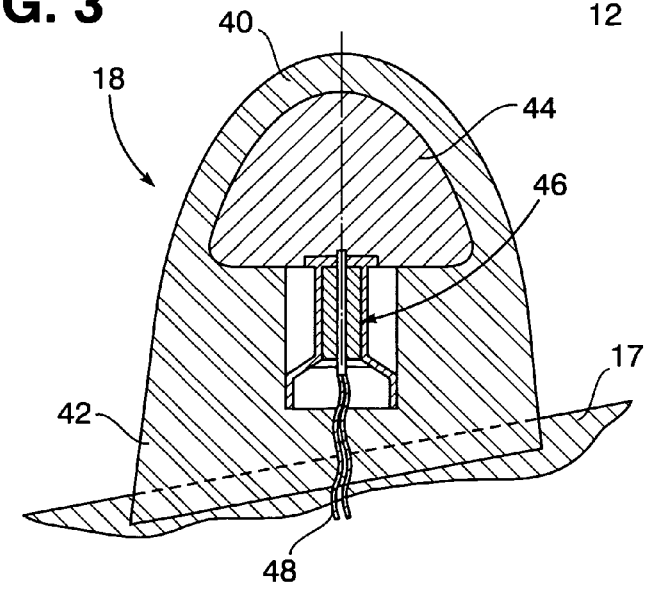
FIG. 3 is a partial section view taken substantially through a plane indicated by section line 3—3 in FIG. 1.

As denoted in FIG. 3, each of the propeller blades 18 has associated therewith an outer tip 40 made of a deform able shape memory alloy such as Nitipole. The tip 40 extends radially from a base portion 42 of the blade 18 fixed to the propeller hub section 17 of the hull 10. According to one embodiment of the present invention, a torque actuator is formed by a plate 44 embedded within the blade tip 40 and connected to an electrical torsional transmitter 46 from which the aforementioned electrical wiring 48 extends through the shaft 12 and the slip ring assembly 36 to the controller 38.

Figure 4:
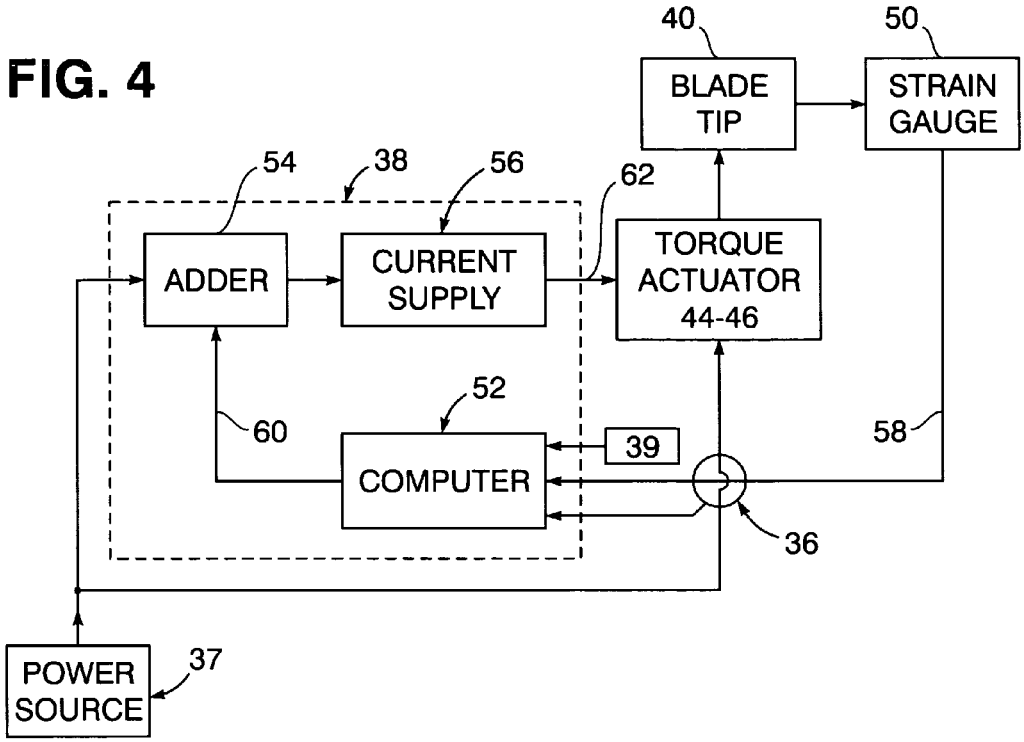
FIG. 4 is a diagram of a propulsion control system associated with the arrangement illustrated in FIGS. 1–3.

As diagrammed in FIG. 4, a strain gauge 50 associated with the propeller blade tip 40 detects strain in the blade tip 40 by generation of a signal that is applied to a computer 52 within the controller 38 to effect controlled adjustment of the propeller blade 18. The computer 52 within the controller 38 receives through a signal line 58 blade deflection signals from the strain gauge 50 as measurement of stress imposed on the propeller blade tip 40 during propulsion operation of the propeller unit 16. In response to such input of blade deflection signals from the strain gauge 50, the computer 52 generates control signals that are applied through a signal line 60 together with pre-existing deflection signals from an adder 54 connecting a power source 37 to an electrical power current supply 56 in the controller 38, from which electrical control adjustment energy is applied through a line 62 to the aforementioned torque actuator 44–46. In addition to the variable input from the propeller blade tip strain gauge 50 through line 58, other variable inputs to the computer 52 include water temperature signals from the aforementioned temperature gauge 39 and propeller rotation rate signals from the slip ring assembly 36 so as to improve cavitation conditions occurring at the blade tips 40.

When electrical pulse current is supplied through line 62 the current supply 56 in the controller 38 under control of the computer 52, the torque actuator plate 44 embedded in the blade tip 40 effects heating of its shape memory alloy material causing rotational deformation thereof in response to the aforementioned strain producing stress. Upon deenergization of the heated torque actuator plate 44, it returns to its ambient temperature for released twist return of the blade tip 40 to its ambient state by the strain energy stored therein. Adjustments effected in response to changes in environmental conditions of the seawater through which the hull 10 is being propelled by the propulsion unit 16 is thereby rendered more efficient over a wide range of environmental changes by rotational adjustment of the propeller blades 18 under deformation control in a most economical and reliable manner. Furthermore, the foregoing described and/or referred to arrangement of parts, components and selection of shape memory alloy material associated with the propeller blades 18 is not only applicable to propulsion of the hull 10 of a craft such as a submarine through the dynamic fluid environment of seawater, but is also applicable to propeller blade propulsion of aircraft through air space as another type of fluid environment.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a hull having a propulsion unit with propeller blades undergoing rotation about an axis extending through the hull for propulsion thereof through a fluid environment, a system for adjusting each of said propeller blades to maintain efficiency of said propulsion of the hull through said fluid environment under widely changing conditions thereof, comprising: actuator means within the propeller blade for adjustment by deflection thereof during said propulsion of the hull; controller means sealed within the hull for regulation of said deflection of the propeller blade by the actuator means in accordance with the changing conditions of the fluid environment, a propeller shaft extending along said axis through the hull between a propulsion source of power and a hub on which the propeller blades are mounted; and wiring means extending through the propeller shaft operatively interconnecting within the hull for effecting said adjustment deflection of the propeller blades and said regulation of the deflection.

2. In combination with a hull having a propulsion unit with propeller blades undergoing rotation about an axis extending through the hull for propulsion thereof through a fluid environment, a system for adjusting each of said propeller blades to maintain efficiency of said propulsion of the hull through said fluid environment under widely changing conditions thereof, comprising: actuator means within the propeller blade for adjustment by deflection thereof during said propulsion of the hull; and controller means sealed within the hull for regulation of said deflection of the propeller blade by the actuator means in accordance with the changing conditions of the fluid environment, each of the propeller blades having a tip portion made of a shape memory alloy material within which the actuator means is disposed so as to effect said deflection as angular deformation of the tip portion.

3. The system as defined in claim 2, wherein said actuator means comprises: a heating plate embedded in the tip portion of the propeller blade and a torsion strain transmitter connected to the plate and extending radially therefrom through the propeller blade.

4. The system as defined in claim 3, wherein said controller means comprises: sensing means for generating input signals respectively reflecting temperature of the fluid environment and strain imposed on the propeller blades by the actuator means; and computer means connected to a source of electrical power for supply of electrical operation signals to the actuator means in response to said input signals to selectively effect said deflection of the propeller blades.

5. The combination as defined in claim 4, including a propeller shaft extending along said axis through the hull between a propulsion source of power and a hub on which the propeller blades are mounted; and wiring means extending through the propeller shaft operatively interconnecting the controller means and the actuator means within the hull for electrically conducting said computer input and actuator operating signals within the hull.

6. The combination as defined in claim 5, wherein said fluid environment is seawater.

7. In combination with a hull having a propulsion unit with propeller blades undergoing rotation about an axis extending through the hull for propulsion thereof through a fluid environment, a system for adjusting each of said propeller blades to maintain efficiency of said propulsion of the hull through said fluid environment under widely changing conditions thereof, comprising: actuator means within the propeller blade for adjustment by deflection thereof during said propulsion of the hull; and controller means sealed within the hull for regulation of said deflection of the propeller blade by the actuator means in accordance with the changing conditions of the fluid environment, said controller means comprising: sensing means for generating input signals respectively reflecting temperature of the fluid environment and strain imposed on the propeller blades by the actuator means; and computer means connected to a source of electrical power for supply of electrical operation signals to the actuator means in response to said input signals to selectively effect said deflection of the propeller blades.

* * * * *